US012365425B1

(12) United States Patent
Bruno

(10) Patent No.: US 12,365,425 B1
(45) Date of Patent: Jul. 22, 2025

(54) SYSTEMS AND METHODS FOR MITIGATION OF EMERGENCY SPLASHDOWN OF FOILING WATERCRAFT

(71) Applicant: Brunswick Corporation, Mettawa, IL (US)

(72) Inventor: Corey L. Bruno, Fond du Lac, WI (US)

(73) Assignee: Brunswick Corporation, Mettawa, IL (US)

( * ) Notice: Subject to any disclaimer, the term of this patent is extended or adjusted under 35 U.S.C. 154(b) by 815 days.

(21) Appl. No.: 17/586,122

(22) Filed: Jan. 27, 2022

(51) Int. Cl.
*B63B 79/30* (2020.01)
*B63B 1/24* (2020.01)
*B63B 79/10* (2020.01)
*B63B 79/40* (2020.01)

(52) U.S. Cl.
CPC ..... *B63B 79/30* (2020.01); *B63B 1/24* (2013.01); *B63B 79/10* (2020.01); *B63B 79/40* (2020.01)

(58) Field of Classification Search
CPC ..... B63B 79/30; B63B 79/20; B63B 79/10
See application file for complete search history.

(56) References Cited

U.S. PATENT DOCUMENTS 3,156,209 A * 11/1964 Ask ..... B63B 1/286 114/275
3,800,727 A * 4/1974 Stark ..... B63B 1/30 318/566
3,886,884 A * 6/1975 Stark ..... B63B 1/24 114/275
3,899,987 A * 8/1975 Wright ..... G05D 1/0875 114/275
4,182,256 A * 1/1980 Scott ..... B63B 1/286 114/276
6,164,235 A * 12/2000 Hoppe ..... B63B 1/12 114/280
6,273,771 B1 * 8/2001 Buckley ..... G08G 3/02 114/144 RE
6,948,441 B2 * 9/2005 Levine ..... B63B 1/242 114/274
7,182,036 B2 * 2/2007 Levine ..... B63B 1/285 114/274
7,198,000 B2 4/2007 Levine
2025/0074546 A1 * 3/2025 Johannesson ..... B63B 1/30

* cited by examiner

*Primary Examiner* — S. Joseph Morano
*Assistant Examiner* — Jovon E Hayes
(74) *Attorney, Agent, or Firm* — Andrus Intellectual Property Law, LLP

(57) ABSTRACT

A marine propulsion system for a hydrofoil marine vessel includes at least one marine propulsion device, a foil structure configured to raise at least a portion of a hull of the hydrofoil marine vessel system above a waterline when the hydrofoil marine vessel is operating in a foiling mode; and a propulsion controller operably coupled to the at least one marine propulsion device and the foil structure. The propulsion controller is configured to detect a loss of lift event in the foil structure during operation of the hydrofoil marine vessel in the foiling mode. Responsive to detection of the loss of lift event, the propulsion controller is configured to control the at least one marine propulsion device to increase a thrust provided by the at least one marine propulsion device.

22 Claims, 4 Drawing Sheets

SYSTEMS AND METHODS FOR MITIGATION OF EMERGENCY SPLASHDOWN OF FOILING WATERCRAFT

FIELD

The present disclosure generally relates to foil-assisted marine vessels, and particularly to systems and methods for mitigating the effects of an emergency splashdown event for foil-assisted marine vessels.

BACKGROUND

U.S. Pat. No. 3,800,727 discloses a control system for a hydrofoil characterized in that a transition from the foil-borne to the hull-borne mode of operation is initiated and the craft caused to descend or land automatically before an unsafe foil-borne roll or yaw attitude can be developed. This is achieved by providing an auxiliary electronic power source and auxiliary servo feedbacks in parallel with the main feedbacks for the control surface servos of the hydrofoil. The auxiliary feedbacks provide means for positioning the control surfaces to automatically land the craft upon the occurrence of a failure in the primary power source for the hydrofoil or some other off-normal condition.

U.S. Pat. No. 3,886,884 discloses a control system for a hydrofoil of the type having forward and aft submerged foils for supporting the craft while foil borne. In the preferred embodiment of the invention, separate pairs of starboard and port control flaps are provided on the aft foil; while the forward foil, also provided with flap means, is carried at the lower end of a pivoted strut which acts as a rudder. The system incorporates a high degree of redundancy for safety and failproof operation. Craft motions are sensed by gyroscopes and accelerometers which produce signals for controlling the flaps to provide smooth riding characteristics and a minimum of acceleration on passengers and crew for all seaway conditions. Turning of the craft is achieved by initially activating the flaps to bank the craft about its roll axis, followed by a rudder action. Pitch is controlled by both the forward and aft flaps; motions about the roll axis are controlled by the aft flaps only; while the height of the craft while foil-borne is controlled by the forward flap means only.

U.S. Pat. No. 6,273,771 discloses a control system for a marine vessel incorporating a marine propulsion system that can be attached to a marine vessel and connected in signal communication with a serial communication bus and a controller. A plurality of input devices and output devices are also connected in signal communication with the communication bus and a bus access manager, such as a CAN Kingdom network, is connected in signal communication with the controller to regulate the incorporation of additional devices to the plurality of devices in signal communication with the bus whereby the controller is connected in signal communication with each of the plurality of devices on the communication bus. The input and output devices can each transmit messages to the serial communication bus for receipt by other devices.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

In one embodiment, a marine propulsion system for a hydrofoil marine vessel includes at least one marine propulsion device, a foil structure configured to raise at least a portion of a hull of the hydrofoil marine vessel system above a waterline when the hydrofoil marine vessel is operating in a foiling mode, and a propulsion controller operably coupled to the at least one marine propulsion device and the foil structure. The propulsion controller is configured to detect a loss of lift event in the foil structure during operation of the hydrofoil marine vessel in the foiling mode. Responsive to detection of the loss of lift event, the propulsion controller is configured to control the at least one marine propulsion device to increase a thrust provided by the at least one marine propulsion device.

In one example, the loss of lift event comprises a structural failure of the foil structure indicating a loss of lift supporting the hydrofoil marine vessel. In another example, the loss of lift event comprises a communications failure of the foil structure indicating a loss of lift supporting the hydrofoil marine vessel.

In one example, increasing the thrust comprises operating the at least one marine propulsion device at a predetermined percentage of a maximum thrust capacity. In one example, the predetermined percentage is 100%. In another example, increasing the thrust comprises operating the at least one marine propulsion device at less than 100% of a maximum thrust capability.

In one example, the control system is further configured to detect a velocity of the hydrofoil marine vessel in the foiling mode, and the increase in thrust provided by the at least one marine propulsion device is based at least in part on the velocity of the hydrofoil marine vessel in the foiling mode.

In one example, the control system is further configured to decrease the thrust provided by the at least one marine propulsion device after meeting a thrust increase condition until a velocity of the hydrofoil marine vessel reaches a predetermined safe velocity.

In one example, controlling the at least one marine propulsion device to increase the thrust comprises transmitting a high priority message to the at least one marine propulsion device over a controller area network to immediately increase propulsion output.

In one example, detecting the loss of lift event in the lifting foil is based on a change in at least one of a velocity, acceleration, or jerk of the hydrofoil marine vessel exceeding a predetermined threshold.

In one example, increasing the thrust provided by the at least one marine propulsion device comprises controlling revolutions per minute of a propulsor driveshaft as a control variable. In another example, increasing the thrust provided by the at least one marine propulsion device comprises controlling a torque output as a control variable. In yet another example, increasing the thrust provided by the at least one marine propulsion device comprises controlling a throttle position as a control variable. In yet another example, increasing the thrust provided by the at least one marine propulsion device comprises controlling a current consumed by a motor as a control variable.

According to another implementation of the present disclosure, a method of operating a marine propulsion system for a hydrofoil marine vessel includes detecting a loss of lift event in a foil structure during operation of the hydrofoil marine vessel in a foiling mode. The foil structure is configured to raise at least a portion of a hull of the hydrofoil marine vessel system above a waterline when the hydrofoil marine vessel is operating in a foiling mode. The method further comprises controlling at least one marine propulsion device to increase a thrust provided by the at least one marine propulsion device responsive to detection of the loss of lift event.

Various other features, objects, and advantages of the invention will be made apparent from the following description taken together with the drawings.

BRIEF DESCRIPTION OF THE DRAWINGS

The present disclosure is described with reference to the following Figures.

DETAILED DESCRIPTION

Hydrofoil marine vessels include foils, that is, submerged "wing" structures, that are coupled to the hull of the marine vessel by struts. When the marine vessel is traveling at a high speed, the water flow over the foils creates a lifting force that causes the vessel to rise in the water. Sufficiently high speeds can produce enough lift to raise the hull of the marine vessel entirely out of the water. Cruising with the marine vessel's hull out of the water is known as foiling, and it produces a fast, efficient, and comfortable ride to the occupants of the marine vessel. This is because a foilborne vessel is not subject to drag effects of water on the hull, nor the pitch and roll motions caused by waves acting on the hull. Accordingly, hydrofoil marine vessels have been embraced for a variety of applications, including racing, ferrying, and military transport.

Various modes of propulsion (e.g., sails, waterjets, outboard motors) may be utilized by the hydrofoil marine vessel to achieve the speed required to operate in a foiling mode. However, once the vessel is foilborne, obstructions in the water such as floating logs, rocks, and sandbars can pose a significant risk to continued operation in foiling mode and to the vessel in general. The present inventor has recognized that if a hydrofoil marine vessel suffers a sudden loss of lift due to a failure of the foil system (e.g., a structural failure due to the foils striking an object in the water, a communications failure between the foils and a foil controller), the hydrodynamic resistance encountered by the hull as it rapidly re-enters the water can be extremely dangerous due to the great discrepancy in density between air and water (i.e., air is approximately 800 times less dense than water at sea level). The present disclosure provides embodiments of a hydrofoil powerboat vessel having a propulsion system, and a control system and method therefor, that detects a loss of lift event and mitigates the danger to the vessel and its occupants by increasing the thrust generated by the propulsion system upon detection of the loss of lift event in order to safely control the vessel deceleration.

Figure 1:
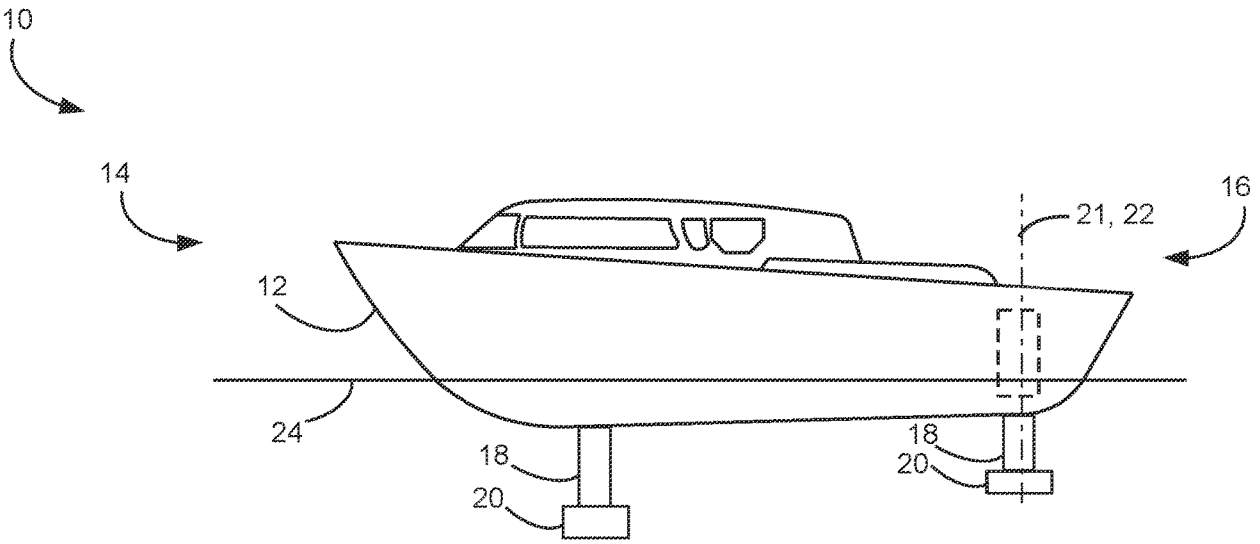
FIG. 1 is a schematic side view representation of an exemplary hydrofoil marine vessel configured to implement an emergency splashdown mitigation procedure according to the present disclosure.
Figure 2:
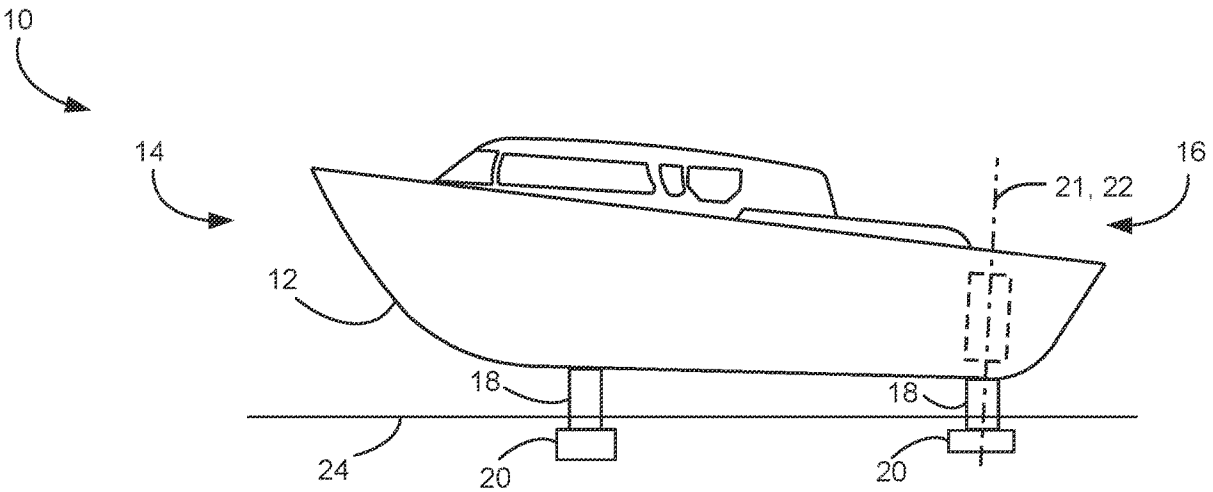
FIG. 2 is a schematic side view representation of the hydrofoil marine vessel of FIG. 1 operating in a foiling mode.
Figure 3:
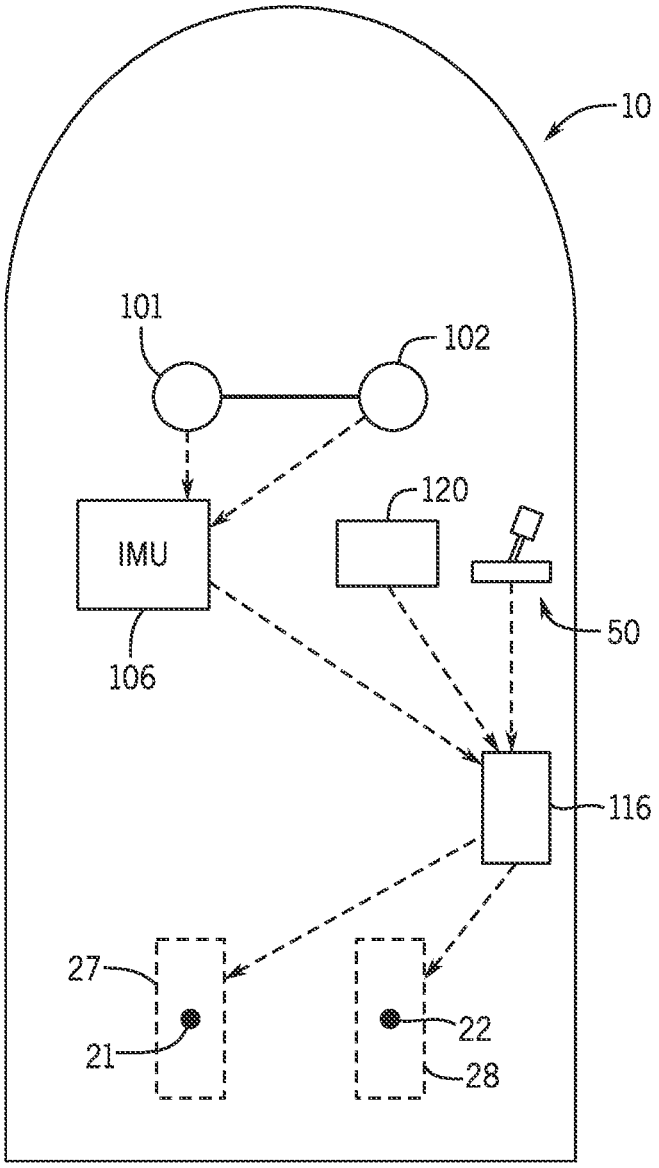
FIG. 3 is a schematic representation of an exemplary hydrofoil marine vessel configured to perform emergency splashdown mitigation in accordance with the present disclosure.

FIGS. 1-3 depict schematic views of a hydrofoil marine vessel 10 according to an exemplary implementation of the present disclosure. The marine vessel 10 is shown to include a hull 12 that extends from a fore end 14 to an aft end 16. First and second propulsion devices (reference numerals 27 and 28 in FIG. 3) are represented by steering axes 21 and 22 and are positioned at the aft end 16 of the hull 12. Although FIGS. 1 and 2 depict the hydrofoil marine vessel 10 as a cabin cruiser-type powerboat, the type of hydrofoil marine vessel 10 is not particularly limited and the invention described herein may be utilized on any type of powerboat that utilizes at least one propulsion device, such as an outboard drive, and inboard drive, a stern drive, a jet drive, or other drive arrangement. In addition, the systems and methods described herein are similarly applicable to internal combustion or electric-powered propulsion devices.

The marine vessel 10 is further shown to include hydrofoiling structural components that extend from a lower surface of the hull 12. These structural components include struts 18 and foils 20. As shown in FIGS. 1 and 2, and the marine vessel 10 may include a first strut 18 and foil 20 structure positioned near the fore end 14 of the hull 12 and a second strut 18 and foil 20 structure positioned near the aft end 16 of the hull 12. In some implementations, the second strut 18 and foil 20 are located in a skeg region (not shown) of the vessel 10.

In some implementations, one or more propulsors (not shown), such as one or more propellers or impellers, driven by the first and second propulsion devices 27, 28 are incorporated into the hydrofoiling structural components positioned at the aft end 16 of the marine vessel 10. In other implementations, the marine vessel 10 utilizes conventional outboard motors such that the propulsors driven by the first and second propulsion devices 27, 28 are positioned separate from the hydrofoiling structural components. The propulsors create a thrust force in the body of water that propels the marine vessel 10 while the vessel 10 is operating in both foiling and non-foiling modes.

The specific details of the geometry of the struts 18 and foils 20 (e.g., hydrofoil shape, strut length) are not particularly limited. For example, the foils 20 may have any known hydrofoil shape (e.g., a National Advisory Committee for Aeronautics (NACA) profile) that results in fluid moving more quickly over an upper surface of the foil 20 as compared with a lower surface of the foil 20. This discrepancy in speeds of fluid moving over the surfaces of the foils 20 is due in part to viscous effects that lead to the formation of vortices at the trailing edges of the foils 20. As the speed along a streamline of fluid traveling over the upper surfaces of the foils 20 increases, the pressure drops, leading to a lower ambient pressure above the foils 20, and the resulting net force on the foils 20 is a lifting force that raises the hull 12 of the marine vessel (see FIG. 2).

In various implementations, certain aspects of the foil structure including the struts 18 and foils 20 may be actuatable between various configurations and positions to achieve optimal foiling conditions. For example, in some implementations, the foil structure may include an actuating mechanism that varies the angle of attack of one or more of the foils 20 to generate desired lift. The angle of attack refers to the angle of the foil relative to the incoming fluid flow. In general, hydrofoils require smaller angles of attack (e.g., 150 or less) as compared with airfoils. In other implementations, the struts 18 may be retractable or foldable, such that the foils 20 are only positioned beneath the hull 12 as depicted in FIGS. 1 and 2 when operating in the foiling mode or preparing to operate in the foiling mode. With retractable or foldable systems, the foils 20 may be located within the hull 12 or folded up alongside the hull 12 when the marine vessel is not operating in the foiling mode. For vessels that include fixed foil structures, operation in the foiling mode may be achieved and detected once the vessel 10 reaches a predetermined speed. For vessels that include retractable or foldable systems, operation in the foiling mode may be achieved and detected based on multiple parameters (e.g., speed of the vessel 10, angle of attack of the foils 20, deployment height of the struts 18).

FIG. 1 depicts the vessel 10 operating in a non-foiling mode in which a portion of the vessel hull 12 sits below the waterline 24. As depicted in FIG. 2, when the vessel 10 is operating in the foiling mode, the lift generated by the foils 20 raises the vessel hull 12 above the waterline 24. The decrease in drag on the hull 12 when the vessel 10 is operating in the foiling mode significantly reduces the demand on the propulsion devices 27, 28. For example, a vessel 10 with a maximum propulsion output of 150 horsepower (hp) may only require an output of 75 hp from the propulsion devices 27, 28 when operating in the foiling mode. Various sensed parameters may be utilized to determine that the vessel 10 is operating in foiling mode including, but not limited to, resistance as a function of speed or trim angle of the vessel 10, vertical motion or acceleration of the vessel 10, angle of attack of the foils 20, deployment height of the foils 20, or sensed load on the foils 20.

FIG. 3 is a schematic representation of a marine vessel 10 which is configured to perform the steps of a preferred embodiment relating to a method for maintaining a marine vessel in a selected position. The marine vessel 10 is provided with a global positioning system (GPS) which, in a preferred embodiment, comprises a first GPS device 101 and a second GPS device 102 which are each located at a preselected fixed position on the marine vessel 10. Signals from the GPS devices are provided to an inertial measurement unit (IMU) 106. In certain embodiments, the IMU 106 comprises a differential correction receiver, accelerometers, angular rate sensors, and a microprocessor which manipulates the information obtained from these devices to provide information relating to the current position of the marine vessel 10, in terms of longitude and latitude, the current heading of the marine vessel 10, and the velocity and acceleration of the marine vessel 10 in six degrees of freedom. In other words, the IMU 106 is able to detect and quantify pitch, roll, and yaw movements of the marine vessel 10.

FIG. 3 also shows a control system or propulsion controller 116 which receives inputs from the IMU 106. The propulsion controller 116 also receives information from a foil structure controller 120 which allows the operator of the marine vessel 10 to control various aspects of the foil structure, as described above with reference to FIGS. 1 and 2. For example, in some implementations, the foil structure controller 120 may allow an operator to modify an angle of attack of one or more of the foils 20, and the angle of attack of the foils 20 may be sensed and communicated to the foil structure controller 120 using a sensor system. Both the propulsion controller 116 and the foil structure controller 120 may include a memory and a programmable processor. A manually operable control device, such as a throttle lever or steering wheel 50, can also be used to provide a signal to the propulsion controller 116. The throttle lever 50 can be used to allow the operator of the marine vessel 10 to manually maneuver the marine vessel.

As described above, the first and second marine propulsion devices, 27 and 28, are steerable about their respective axes, 21 and 22. Signals provided by the propulsion controller 116 allow the first and second marine propulsion devices 27, 28 to be independently rotated about their respective steering axes in order to coordinate the movement of the marine vessel 10 in response to operator commands. In an exemplary implementation, any or all of the propulsion devices 27 and 28, throttle lever 50, GPS devices 101 and 102, IMU 106, propulsion controller 116, and foil structure controller 120 may be communicatively coupled using a controller area network (CAN) bus. In an exemplary implementation, data messages are transmitted to any node or device on a CAN bus and do not contain addresses of either the transmitting node or the intended receiving node. Instead, the content of the message is labeled by an identifier that is unique throughout the network. All other nodes on the network receive the message and each performs an acceptance test on the identifier to determine if the message, and thus its content, is relevant to that particular node. If the message is relevant, it will be processed. Otherwise, the message is ignored. The unique identifier also may determine the priority of the message. In one example, the lower the numerical identifier, the higher the priority of the message. The higher priority message will gain access to the CAN bus as if it were the only message being transmitted at that time. Lower priority messages are automatically retransmitted in the next bus cycle, or in a subsequent bus cycle if there are still other higher priority messages waiting to be sent.

Figure 4:
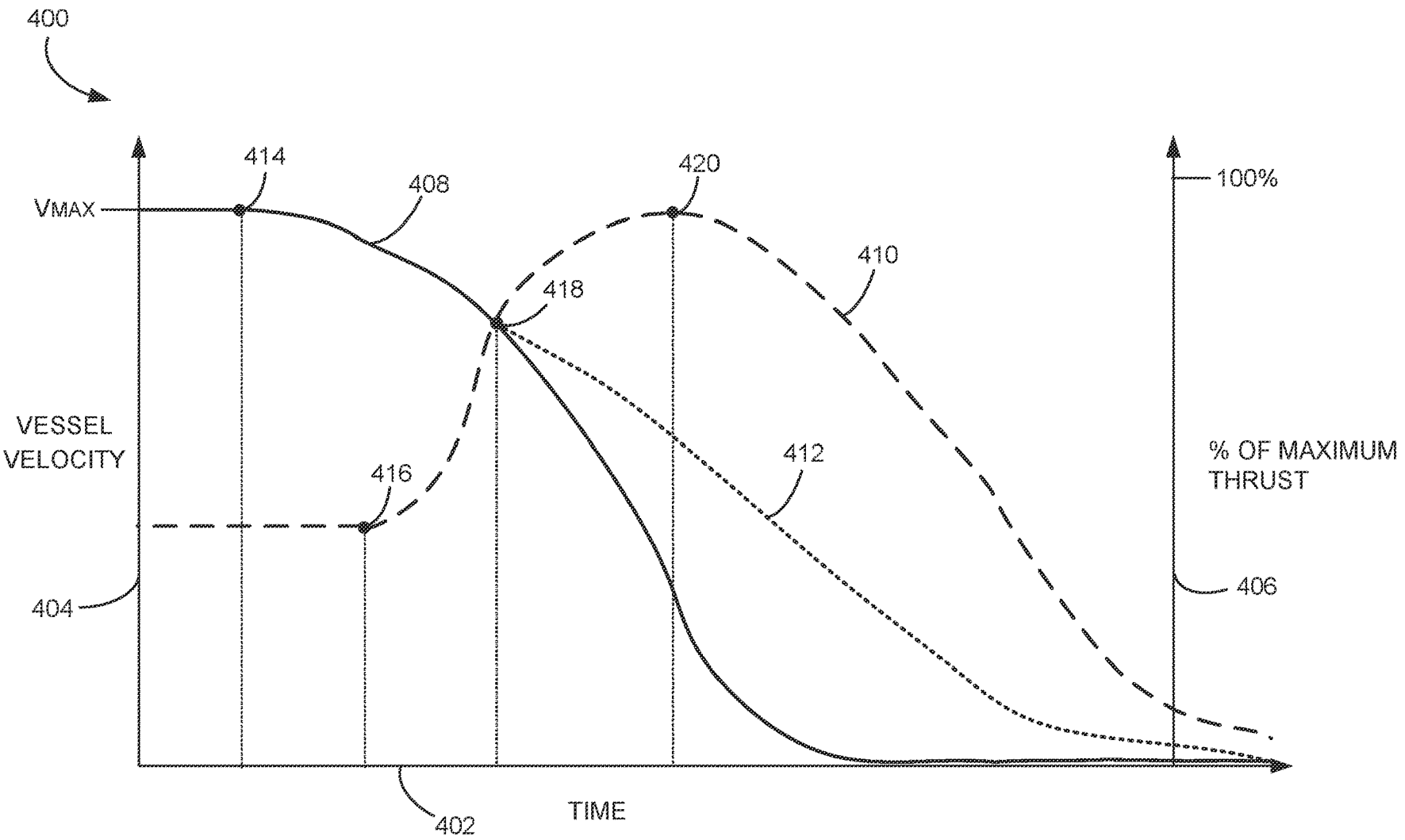
FIG. 4 is a plot depicting the velocity and thrust of a hydrofoil marine vessel during an exemplary emergency splashdown mitigation process.

FIG. 4 depicts a plot 400 illustrating the operation of a hydrofoil marine vessel during an emergency splashdown in the absence of mitigation intervention, as well as when mitigation intervention according the invention described herein is performed. The plot 400 is shown to include a horizontal axis 402, a first vertical axis 404, and a second vertical axis 406. The horizontal axis 402 represents time. In an exemplary implementation, the entire span of time depicted on axis 402 is quite brief (e.g., less than 10 seconds). The first vertical axis 404 located on the left side of the plot 400 represents the velocity of the hydrofoil marine vessel 10. The second vertical axis 406 located on the right side of the plot 400 represents the percentage of maximum thrust provided by the propulsion system (e.g., first and second marine propulsion devices 27 and 28) of the marine vessel 10. Since the propulsion devices 27, 28 may be, in various implementations, internal combustion engines or electric drive motors, the percentage of maximum thrust may correspond to various control variables that may be controlled by the propulsion controller 116, including the revolutions per minute (RPM) of a propulsor driveshaft as compared with a maximum driveshaft RPM, a torque output as compared with a maximum torque output, a throttle position as compared with a wide open throttle position, or a current consumed by the motor as compared with a maximum current.

Prior to time 414, the velocity of the hydrofoil marine vessel 10 (shown on plot 400 as the solid line 408) is at a local maximum value, $V_{max}$, as the vessel 10 operates in the foiling mode. Typical velocities of the vessel 10 in foiling mode may range from 10 knots for a smaller vessel to 50 knots or more for larger vessels. At the same time, the percentage of maximum thrust provided by the propulsion system (shown on plot 400 as the dashed line 410), is less than 100%. As described above, due to the reduction in drag on the hull 12 due to its position above the waterline 24, the demand on the propulsion devices 27, 28 is significantly less when operating in foiling mode than the demand that would be experienced if the vessel was operating at the same velocity in non-foiling mode.

At time 414, the hydrofoil marine vessel 10 suffers a loss of lift event. The loss of lift event may be caused by a structural failure of the foil system, including the struts 18 and/or the foils 20. The structural failure may be due to conditions external to the marine vessel 10. For example, the vessel 10 may strike an object in the water (e.g., a log, a rock), or may be operating in insufficiently deep water, causing the struts 18 and/or foils 20 to strike a sandbar and fracture or sustain significant damage. In other examples, the loss of lift event may be due to conditions internal to the marine vessel 10. For example, the foil system may suffer a mechanical failure (e.g., failure of actuators that control the angle of attack of the foils 20) or a communications failure (e.g., interruption of communications between the foil structure controller 120 and actuators that control the angle of attack of the foils 20, interruption of communications between the foil structure controller 120 and angle of attack sensors that sense the positions of the foils 20, interruption of communications between the IMU 106 and the propulsion controller 116) that results in a splashdown event and/or otherwise prevents the vessel 10 from continual operation in foiling mode.

Graph line 408 exemplifies the behavior of a marine vessel following a sudden loss of lift event, where the velocity of the marine vessel 10 (indicated by solid line 408) begins to decelerate very rapidly after the loss of lift event at time 414 until it reaches zero. As described above, due to the discrepancy in the densities of air and water, a sudden interruption in the lifting force that causes the hull 12 of the vessel 10 to drop back below the waterline 24 can be highly dangerous to the marine vessel 10 and its occupants.

However, if the marine vessel 10 is operating according to the disclosed emergency mitigation methods and systems, at time 416, the loss of lift event is detected. As described in further detail below with reference to FIG. 5, the loss of lift event may be detected by the control system (e.g., propulsion controller 116) based on various parameters detected by the IMU 106, or via messages (or a lack thereof) from the foil structure controller 120. Responsive to detection of the loss of lift event, the propulsion controller 116 operates the propulsion devices 27, 28 to increase their thrust output, as indicated by the dashed line 410. At time 418, the propulsion devices 27, 28 provide enough thrust to contribute to a change in the velocity of marine vessel 10. Accordingly, dotted line 412 depicts the velocity of the marine vessel 10 when the emergency mitigation methods are employed. As shown, the increase in thrust provided by the propulsion devices 27, 28 slows the deceleration of the marine vessel 10, resulting in a far safer transition from the foiling mode to the non-foiling mode as the hull 12 of the vessel drops back below the waterline 24.

At time 420, the thrust output of the propulsion devices 27, 28 indicated by dashed line 410 reaches a maximum representative of a predetermined thrust increase condition, before beginning to decline after time 420. For example, the thrust provided by the propulsion devices 27, 28 may decrease by 5% per second until the velocity of the vessel 10 reaches zero. In some implementations, the maximum thrust output of the propulsion devices 27, 28 at time 420 is 100% of the maximum thrust that could be provided by these devices (e.g., maximum RPM, wide open throttle, or maximum current). In other implementations, the maximum thrust at time 420 provided by the propulsion devices 27, 28 is less than 100% of the possible maximum thrust, but instead may be a lesser value determined based on sensed parameters or control values at the time of detecting the loss of lift event. For example, an increased target output of one or more of the propulsion device(s) 27, 28 may be determined as a multiple of the thrust provided prior to detection of the loss of lift event at time 416 (e.g., 1.5× or 2× the thrust provided during normal foiling mode operation). In other embodiments, the increased target output as represented by the speed of the driveshaft, throttle position, or motor current consumption may be determined as a percentage or multiple of the velocity of the marine vessel 10 at the time of detecting the loss of lift event (i.e., time 416).

Figure 5:
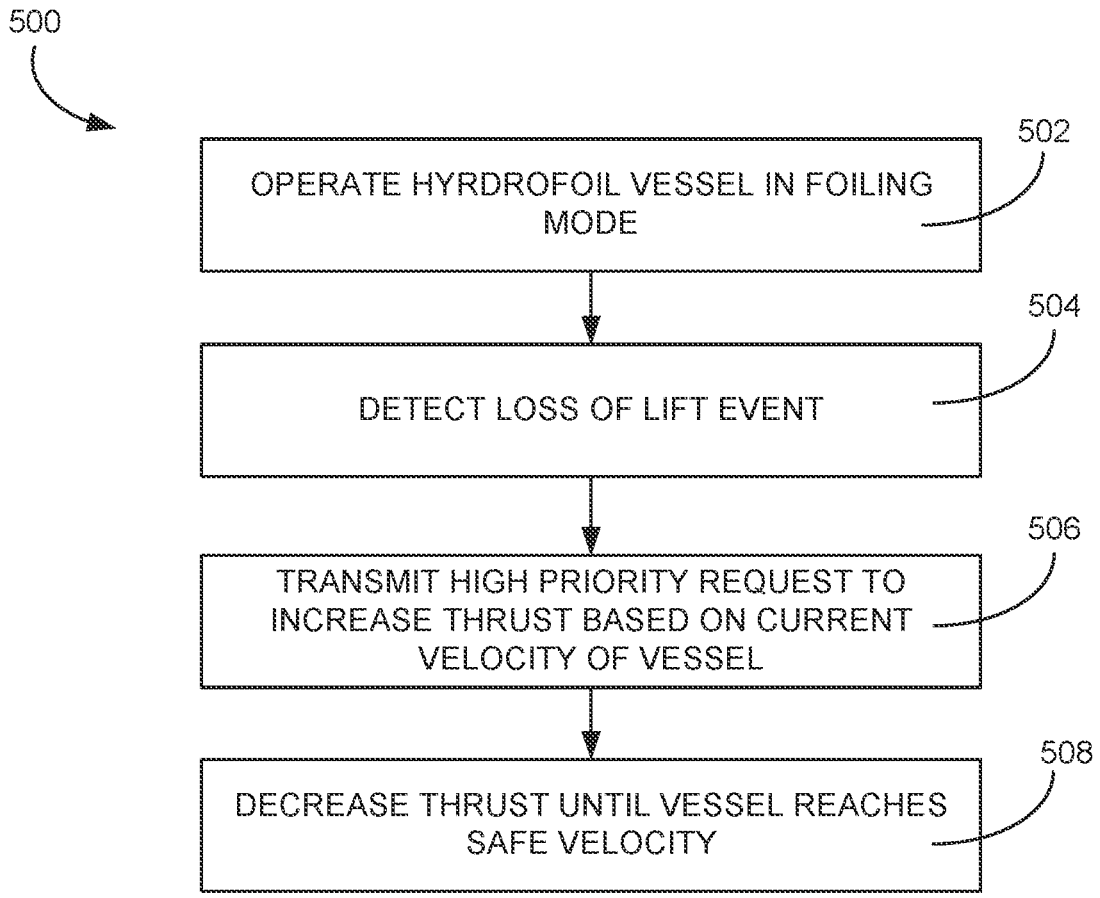
FIG. 5 is a flow chart illustrating an exemplary control method for performing an emergency splashdown mitigation.

FIG. 5 depicts a process 500 for performing an emergency splashdown mitigation process using the hydrofoil marine vessel 10, depicted and described above with reference to FIGS. 1-4. In an exemplary implementation, process 500 is performed at least in part by the propulsion controller 116, as described above with reference to FIG. 3. Process 500 commences with step 502, in which the propulsion controller 116 operates the marine propulsion devices 27 and 28 and the foil structure controller 120 controls the foils 20 of the foiling structure such that the marine vessel 10 operates in a foiling mode. For example, in order to transition the marine vessel 10 from operation in the non-foiling mode (depicted in FIG. 1) to the foiling mode (depicted in FIG. 2), the propulsion controller 116 may command the propulsion devices 27, 28 to provide thrust sufficient to achieve lift using the foil structure (i.e., struts 18 and foils 20). In some implementations, step 502 may further include the foil structure controller modifying various parameters of the foil structure (e.g., extending retractable struts 18, or modifying the angle of attack of the foils 20) in order to operate in foiling mode.

At step 504, the propulsion controller 116 detects a loss of lift event. The loss of lift event may be detected using a variety of methods. In some implementations, the propulsion controller 116 detects the loss of lift event responsive to measurements provided by the IMU 106. For example, the propulsion controller 116 may determine that a change in position (e.g., a pitch, roll, or yaw movement) of the vessel 10 as indicated by the IMU 106 exceeding a predetermined threshold is representative of a loss of lift event (e.g., the foil structure striking a log or rock and causing a heave motion of the vessel 10). The propulsion controller 116 may also determine than an impulse acting upon the vessel 10 as indicated by velocity and/or acceleration measurements supplied by the IMU 106 exceeds a predetermined threshold representative of a loss of lift event. The acceleration measurements supplied by the IMU 106 additionally constrain the amount of time in which the propulsion controller 116 can respond to the loss of lift event, as described below.

In further implementations, the loss of lift event may be determined by the propulsion controller 116 based on communications received from the foil structure controller 120. If the foil structure controller 120 transmits a message to the propulsion controller 116 that the actuators utilized to modify the angle of attack of the foils 20 are no longer responding to commands (e.g., because the actuators and/or the foils 20 were damaged in a log strike event), the propulsion controller 116 may determine that a loss of lift event has occurred based on the lack of actuator response. In still further implementations, the propulsion controller 116 may detect a loss of lift event based on operator error (e.g., an extreme change in heading commanded by the operator using the joystick 50) that would tend to result in failure of operation of the marine vessel 10 in the foiling mode.

At step 506, the propulsion controller 116 responds to detection of the loss of lift event by transmitting a high priority request over the CAN bus to the propulsion devices 27, 28 to immediately increase the thrust provided to the vessel 10. As described above, the high priority request over the CAN bus may include transmitting a message with a unique identifier having a low numerical value that is guaranteed to gain access to the bus as if it were the only message being transmitted at that time. In an exemplary implementation, the increase in thrust may be based upon a current velocity of the vessel 10 as measured by the IMU 106. The faster the vessel 10 is traveling in foiling mode, the greater the increase in thrust responsive to a loss of lift event. The increase in thrust provided by the propulsion devices 27, 28 responsive to the high priority request is depicted between time 416 and 420 on FIG. 4, as described above.

At step 508, process 500 concludes as the propulsion controller 116 decreases the thrust provided by the propulsion devices 27, 28 until the marine vessel 10 reaches a predetermined safe velocity. This is depicted beginning at time 420 on FIG. 4, the time at which the propulsion controller 116 has met a thrust increase condition (i.e., achieved a predetermined maximum thrust value). In some implementations, the safe velocity will be zero, since a loss of lift event is generally associated with a significant threat to safe continued operation of the hydrofoil marine vessel 10. In other implementations, the safe velocity will not be zero but will be some nonzero velocity that is significantly slower than the velocity of the marine vessel 10 while operating in foiling mode.

This written description uses examples to disclose the invention, including the best mode, and to enable any person skilled in the art to make and use the invention. Certain terms have been used for brevity, clarity and understanding. No unnecessary limitations are to be inferred therefrom beyond the requirement of the prior art because such terms are used for descriptive purposes only and are intended to be broadly construed. The patentable scope of the invention is defined by the claims, and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

I claim:

1. A marine propulsion system for a hydrofoil marine vessel, comprising:

at least one marine propulsion device;

a foil structure configured to raise at least a portion of a hull of the hydrofoil marine vessel above a waterline when the hydrofoil marine vessel is operating in a foiling mode;

a propulsion controller operably coupled to the at least one marine propulsion device and the foil structure, wherein the propulsion controller is configured to:

detect a loss of lift event in the foil structure during operation of the hydrofoil marine vessel in the foiling mode; and responsive to detection of the loss of lift event, control the at least one marine propulsion device to increase a thrust provided by the at least one marine propulsion device.

2. The marine propulsion system of claim 1, wherein the loss of lift event comprises a structural failure of the foil structure indicating a loss of lift supporting the hydrofoil marine vessel.

3. The marine propulsion system of claim 1, wherein the loss of lift event comprises a communications failure of the foil structure indicating a loss of lift supporting the hydrofoil marine vessel.

4. The marine propulsion system of claim 1, wherein increasing the thrust comprises operating the at least one marine propulsion device at a predetermined percentage of a maximum thrust capability.

5. The marine propulsion system of claim 4, wherein the predetermined percentage of the maximum thrust capability is 100%.

6. The marine propulsion system of claim 1, wherein the propulsion controller is further configured to detect a velocity of the hydrofoil marine vessel in the foiling mode and wherein the increase in thrust provided by the at least one marine propulsion device is based at least in part on the velocity of the hydrofoil marine vessel in the foiling mode.

7. The marine propulsion system of claim 1, wherein the propulsion controller is further configured to, after meeting a thrust increase condition, decrease the thrust provided by the at least one marine propulsion device until a velocity of the hydrofoil marine vessel reaches a predetermined safe velocity.

8. The marine propulsion system of claim 1, wherein controlling the at least one marine propulsion device to increase the thrust comprises transmitting a high priority request to the at least one marine propulsion device over a controller area network to immediately increase propulsion output.

9. The marine propulsion system of claim 1, wherein detecting the loss of lift event in the lifting foil is based on a change in at least one of velocity, acceleration, or jerk of the hydrofoil marine vessel exceeding a predetermined threshold.

10. The marine propulsion system of claim 1, wherein increasing the thrust provided by the at least one marine propulsion device comprises controlling revolutions per minute of a propulsor driveshaft as a control variable.

11. The marine propulsion system of claim 1, wherein increasing the thrust provided by the at least one marine propulsion device comprises controlling a torque output as a control variable.

12. The marine propulsion system of claim 1, wherein increasing the thrust provided by the at least one marine propulsion device comprises controlling a throttle position as a control variable.

13. The marine propulsion system of claim 1, wherein increasing the thrust provided by the at least one marine propulsion device comprises controlling a current consumed by a motor as a control variable.

14. A method of operating a marine propulsion system for a hydrofoil marine vessel, comprising:

detecting a loss of lift event in a foil structure during operation of the hydrofoil marine vessel in a foiling mode, wherein the foil structure is configured to raise at least a portion of a hull of the hydrofoil marine vessel system above a waterline when the hydrofoil marine vessel is operating in the foiling mode; and responsive to detection of the loss of lift event, controlling at least one marine propulsion device to increase a thrust provided by the at least one marine propulsion device.

15. The method of claim 14, wherein the loss of lift event comprises a structural failure of the foil structure indicating a loss of lift supporting the hydrofoil marine vessel.

16. The method of claim 14, wherein the loss of lift event comprises a communications failure of the foil structure indicating a loss of lift supporting the hydrofoil marine vessel.

17. The method of claim 14, wherein increasing the thrust comprises operating the at least one marine propulsion device at a predetermined percentage of a maximum thrust capability.

18. The method of claim 17, wherein the predetermined percentage of the maximum thrust capability is 100%.

19. The method of claim 14, further comprising detecting a velocity of the hydrofoil marine vessel in the foiling mode, and wherein the increase in thrust provided by the at least one marine propulsion device is based at least in part on the velocity of the hydrofoil marine vessel in the foiling mode.

20. The method of claim 14, further comprising, after meeting a thrust increase condition, decreasing the thrust provided by the at least one marine propulsion device until a velocity of the hydrofoil marine vessel reaches a predetermined safe velocity.

21. The method of claim 14, wherein controlling the at least one marine propulsion device to increase the thrust comprises transmitting a high priority message to the at least one marine propulsion device over a controller area network to immediately increase propulsion output.

22. The method of claim 14, wherein detecting the loss of lift event in the lifting foil is based on a change in at least one of velocity, acceleration, or jerk of the hydrofoil marine vessel exceeding a predetermined threshold.

* * * * *